US007966696B2

(12) United States Patent
Krammer

(10) Patent No.: US 7,966,696 B2
(45) Date of Patent: Jun. 28, 2011

(54) HINGE HAVING A DAMPING DEVICE

(75) Inventor: Bernhard Krammer, Höchst (AT)

(73) Assignee: Julius Blum GmbH, Hoechst (AT)

( * ) Notice: Subject to any disclaimer, the term of this patent is extended or adjusted under 35 U.S.C. 154(b) by 0 days.

(21) Appl. No.: 12/832,292

(22) Filed: Jul. 8, 2010

(65) Prior Publication Data

US 2010/0269294 A1 Oct. 28, 2010

Related U.S. Application Data

(63) Continuation of application No. PCT/AT2009/000018, filed on Jan. 20, 2009.

(30) Foreign Application Priority Data

Feb. 25, 2008 (AT) ..... A 308/2008

(51) Int. Cl.
*E05F 1/08* (2006.01)

(52) U.S. Cl. ..... 16/286; 16/54

(58) Field of Classification Search ..... 16/286, 16/287, 288, 289, 294, 54, 56, 366, 370, 16/371, 354
See application file for complete search history.

(56) References Cited

U.S. PATENT DOCUMENTS

| | | | | |
|---|---|---|---|---|
| 4,979,265 | A * | 12/1990 | Grass | 16/291 |
| 5,269,043 | A * | 12/1993 | Yang | 16/68 |
| 6,536,080 | B2 * | 3/2003 | Bella et al. | 16/412 |
| 6,832,412 | B2 * | 12/2004 | Kim | 16/354 |
| 6,859,979 | B2 * | 3/2005 | Egger et al. | 16/327 |
| 7,003,851 | B2 * | 2/2006 | Salice | 16/285 |
| 7,328,484 | B2 * | 2/2008 | Salice | 16/354 |
| 7,395,580 | B2 * | 7/2008 | Brustle et al. | 16/50 |

FOREIGN PATENT DOCUMENTS

| | | | |
|---|---|---|---|
| AT | 005 477 | | 7/2002 |
| AT | 504 671 | | 7/2008 |
| EP | 1 344 885 | | 9/2003 |
| EP | 1 420 138 | | 5/2004 |
| WO | 03/087512 | | 10/2003 |
| WO | WO 03087512 | A1 * | 10/2003 |
| WO | WO 2004020771 | A1 * | 3/2004 |
| WO | 2004/083580 | | 9/2004 |
| WO | 2007/093191 | | 8/2007 |

OTHER PUBLICATIONS

International Search Report issued May 12, 2009 in International (PCT) Application No. PCT/AT2009/000018.
Austrian Search Report issued Dec. 2, 2008 in Austrian Patent No. A 308/2008.

* cited by examiner

*Primary Examiner* — Chucky Y. Mah
(74) *Attorney, Agent, or Firm* — Wenderoth, Lind & Ponack, L.L.P.

(57) ABSTRACT

A hinge, particularly for movable pieces of furniture, has at least two stop parts connected in an articulated manner (which is to say a hinge arm and a hinge cup) for fastening to pieces of furniture. The hinge has a damping device for damping the hinge movement, and has a restoring mechanism, by which an actuating element of the damping device can be moved into a starting position for the next damping stroke after damping has taken place. The damping device and the restoring mechanism are disposed as separate components on the hinge cup. The damping device, which has no restoring mechanism, is disposed on a lateral wall of the hinge cup, and the restoring mechanism is disposed on an opposing lateral wall of the hinge cup.

17 Claims, 4 Drawing Sheets

HINGE HAVING A DAMPING DEVICE

This application is a continuation application of International application PCT/AT2009/000018, filed Jan. 20, 2009, the entire disclosure of which is incorporated herein by reference.

BACKGROUND OF THE INVENTION

The present invention relates to a hinge, in particular for movable furniture parts, comprising at least two hingedly connected fitment portions, namely a hinge arm and a hinge cup, to be fixed to furniture parts. A damping device is provided for damping the hinge movement and a return mechanism by means of which an actuating element of the damping device can be moved into a ready position for the next damping stroke. The damping device and the return mechanism are arranged as separate component units on the hinge cup.

In the state of the art, it is known to provide furniture dampers with relatively complicated and expensive valve constructions in order to realize a return stroke at the end of the damping stroke so that the actuating element or the damper can be moved into a starting position for the next damping stroke. Those valve-like constructions allow a return flow of the damping medium and thus a restoring movement of the damping components. In general, those valve-like constructions are highly complicated and expensive in construction and manufacture and permit only very small tolerances. An example of such a damping device for movable furniture portions is known for example from WO 03/087512 A1 to the present applicant. This prior art document discloses a damper in which a gap which narrows in the direction of the damping stroke remains free between a damping vane and an inside wall of the damper housing, serving as a bypass opening. The restoring movement of the damper is achieved by a reversal tilting movement of the damping vane at the end of the damping process, thereby causing an increase in the through-flow cross-section for the return of the damping vane.

SUMMARY OF THE INVENTION

The object of the invention is to provide a hinge of the general kind set forth in the opening part of this specification, having a reliable damping action and a structurally simple and effective solution for appropriate restoration of the actuating element of the damping device.

According to the invention, that is achieved in that the damping device—which does not have a return mechanism on its own—is arranged on a side wall of the hinge cup, and that the return mechanism is arranged on an opposite side wall of the hinge cup.

The state of the art in accordance with WO 03/087512 A1 discloses a hinge having a damping device, wherein the damping function and the return function are effected by means of a free-wheel assembly in a common structural unit. In the course of further development of that solution, it was found that spatial separation of the damping function and the return function is advantageous. It was found that basically one single damping device for each hinge, in a suitably solid design, can be sufficient to provide an appropriate damping action. The separation of the damping function and the return function provides the advantage that the respective structural units can be designed to be more stable and more reliable and are thereby less susceptible to failure.

In accordance with a possible embodiment of the invention, the actuating element can be pivotally arranged during the damping stroke and/or during the return stroke. In this connection, the actuating element can be acted upon by a fitment portion of the hinge or by a hinge lever being arranged between said fitment portions during the closing movement of the hinge. In a structurally simple design configuration, the hinge comprises a hinge arm and a hinge cup being pivotally connected directly or indirectly to the hinge arm, wherein the actuating element is arranged within the hinge cup and can be moved within predetermined limits.

In an embodiment of the invention, the actuating element of the damping device can be connected or releasably connectable to a return element of the return mechanism. In that respect, it may be desirable if the actuating element is releasably connectable to the return element by way of a snap connection. The actuating element with the return element forms a structural unit which is inseparable during operation. In other words, a moment acting on the actuating element during the damping process is simultaneously also transmitted to the return element. Conversely, in the return stroke, a moment acting on the return element is also transmitted to the actuating element so that, after damping has occurred, the actuating element is movable again into a ready position for the next damping stroke. That configuration avoids a lateral moment on the actuating element so that one-sided loading of the actuating element can be substantially excluded.

In this connection, it can be provided that a spring device can be tensioned by the return element during the closing movement of the hinge so that after damping has been effected, the return element can be moved—preferably moved back—by the loaded spring device into the ready position for the next damping stroke.

In a preferred embodiment, the damping device comprises a damper housing and the return mechanism comprises a return housing. The damper housing and the return housing are respectively arranged externally on the hinge cup at an outside wall thereof and beneath a fixing flange of the hinge cup in the mounting position of the hinge cup. In this connection, the damper housing can be arranged on a lateral side wall of the hinge cup and the return housing can be arranged on an opposite side wall of the hinge cup. The actuating element can be arranged within or on the hinge cup at a pivot axis which runs substantially parallel to a hinge axis of the hinge. The pivot axis of the actuating element can also run coaxially with respect to a pivot axis of the damping device and/or coaxially with respect to the pivot axis of the return element.

BRIEF DESCRIPTION OF THE DRAWINGS

Further details and advantages of the present invention will be described with reference to the specific description hereinafter. In the drawings.

DETAILED DESCRIPTION OF THE INVENTION

Figure 1:
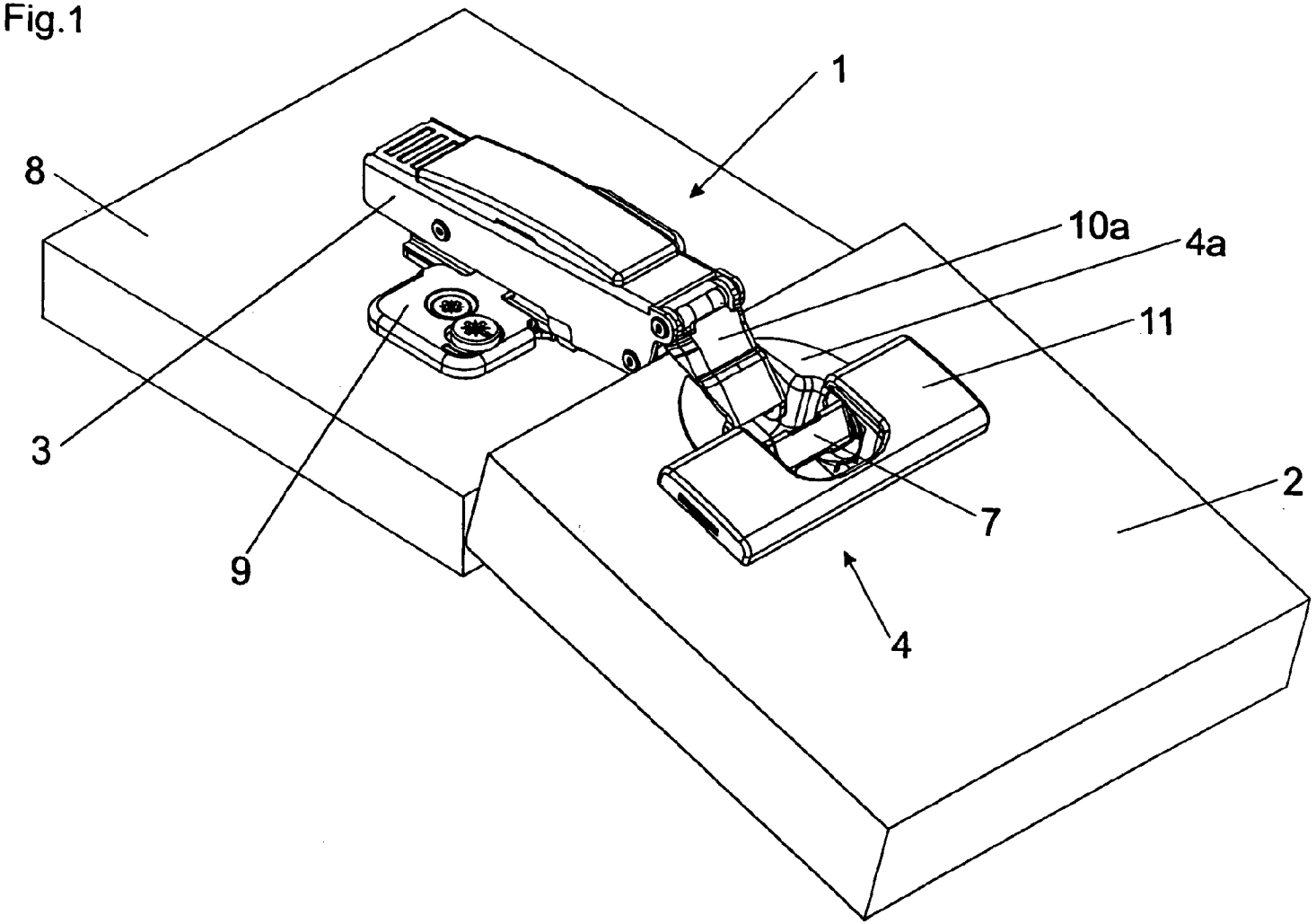
FIG. 1 show a perspective view of a hinge according to the invention in the mounted position.

FIG. 1 shows a perspective view of a hinge identified overall by reference 1, in the mounted position. The hinge 1 includes in a conventional manner a base plate 9 which is screwed to the furniture carcass 8 and onto which a first fitment portion 3 in the form of a hinge arm can be clipped. In addition, the hinge 1 comprises an inner hinge lever 10*b* and an outer hinge lever 10*a* which connect the second fitment portion 4 with the hinge cup 4*a* hingedly to the stationary first fitment portion 3. The inner hinge lever 10*b* is concealed in the illustrated view by virtue of its cranked configuration. A bore (which cannot be seen here) into which the hinge cup 4*a* is sunk—as is known per se—is provided on the movable furniture portion 2. A fixing flange 11 is also provided for fastening the hinge cup 4*a*. Visible is an actuating element 7 which is pivotally mounted within the hinge cup 4*a* and which can be moved in the range of predetermined limits. An actuating mechanism includes the outer hinge lever 10*a* and the actuating element 7 interconnected to act as described below. In particular, the actuating element 7 is acted upon by the outer hinge lever 10*a* as from a certain closing position of the hinge 1. When the actuating element 7 is pressed into the hinge cup 4*a* by outer hinge lever 10*a*, a damping device 5 (not shown in greater detail here) is actuated, by which the hinge movement can be damped over the last closing region towards the fully closed position of the hinge 1.

Figure 2B:
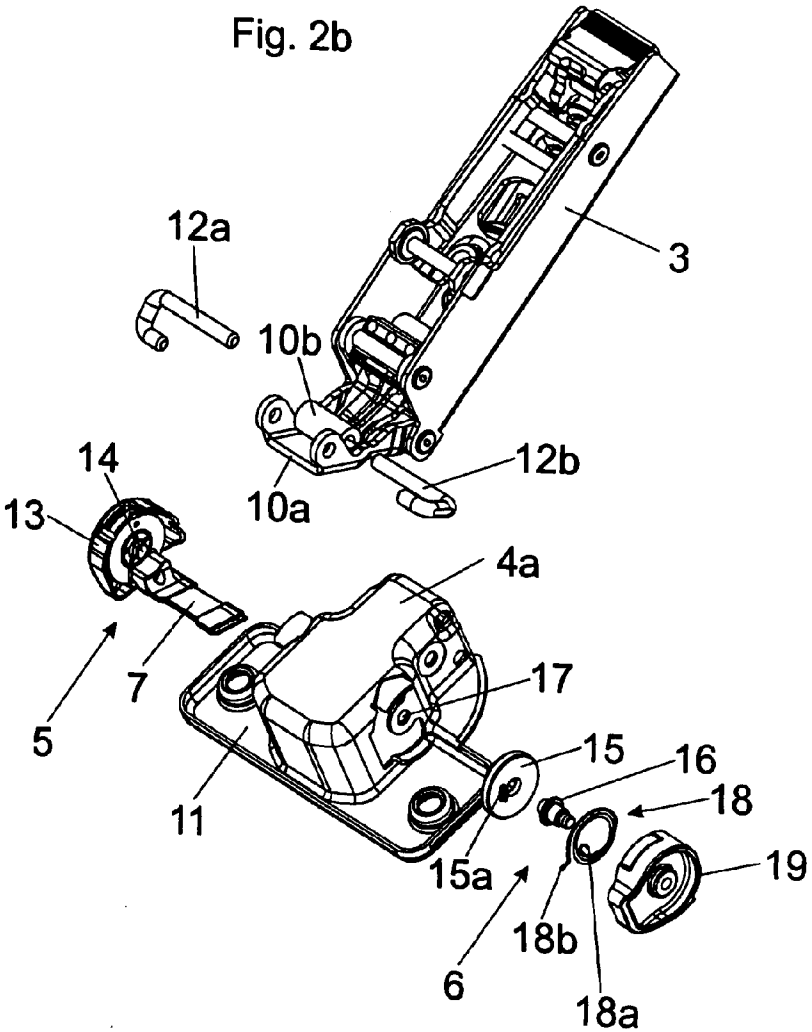
FIGS. 2*a*, 2*b* are a perspective view of the hinge cup in the assembled condition and a perspective view from below of the hinge in an exploded condition.
Figure 2A:
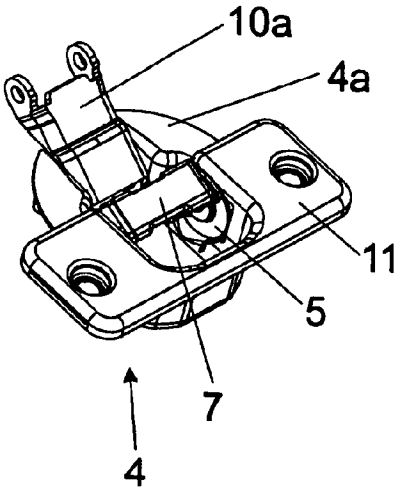

FIG. 2*a* shows the second fitment portion 4 having the hinge cup 4*a* and the outer hinge lever 10*a* which acts on the actuating element 7 which is mounted rotatably within the hinge cup 4*a*. It is possible to see a damping device 5 in the form of a rotational damper, which is operatively connected to the actuating element 7 and which in the mounted position is fastened externally to the hinge cup 4*a* at the lateral outside wall thereof and beneath the fixing flange 11 of the hinge cup 4*a*.

FIG. 2*b* shows a perspective view (from below) of the hinge 1 in an exploded condition. It is possible to see the first fitment portion 3 in the form of the hinge arm, which is to be fastened to the furniture carcass 8 and which can be latched to the base plate 9 shown in FIG. 1. Mounted on the hinge arm 3 is the outer hinge lever 10*a* and a cranked inner hinge lever 10*b*, wherein hinge pins 12*a*, 12*b* provide an articulated connection with respect to the hinge cup 4*a*. It is also possible to see the damping device 5 in the form of a rotational damper which includes a damper housing 13 and the actuating element 7 in the form of a pivotal lever which is mounted at the axis of rotation 14. In the mounted position, the damper housing 13 is fastened to a lateral outside wall of the hinge cup 4*a*. It is essential that a structural unit, separate from the damping device 5, for the return mechanism 6 is provided on the outside of the opposite outside wall of the hinge cup 4*a*. The return mechanism 6 moves the actuating element 7 of the damping device 5 back into a ready position for the next damping stroke, after damping has occurred. For that purpose, the return mechanism 6 comprises a rotatably mounted return element 15 which in the mounted position is connected to the free end of the actuating element 7 of the damping device 5. Desirably, a snap connection is provided for fastening the actuating element 7 to the return element 15. Provided for mounting the return mechanism 6 to the hinge cup 4*a* is a journal member 16 which in the assembled condition of the hinge 1 engages into the shaft hole 17 at a lug provided on the hinge cup 4*a*. An item of relevance is a spring device 18 which in the illustrated embodiment is in the form of a torsion spring and which serves as a return spring for the return element 15 (and thus for the actuating element 7). The spring device 18 in the form of the torsion spring includes a first free end 18*a* which engages a mounting point 15*a* of the return element 15. The second free end 18*b* of the spring device 18 is fixed at the stationary return housing 19. In the damping stroke, therefore, the actuating element 7 of the damping device 5 is urged into the hinge cup 4*a* by the outer hinge lever 10*a*, whereby the return element 15 of the return mechanism 6 is also rotated about the journal member 16. The spring device 18 is thus also tensioned in the course of that closing movement of the hinge 1. When the actuating element 7 is urged fully into the hinge cup 4*a*, the spring device 18 is also loaded to its maximum. When the actuating element 7 is relieved of load again by the outer hinge lever 10*a*, the return element 15 (and therewith the actuating element 7) is urged out of the hinge cup 4*a* again by the energy stored in the spring device 18 so that after damping has occurred the actuating element 7 can again assume a position intended for the next damping stroke.

Figure 3B:
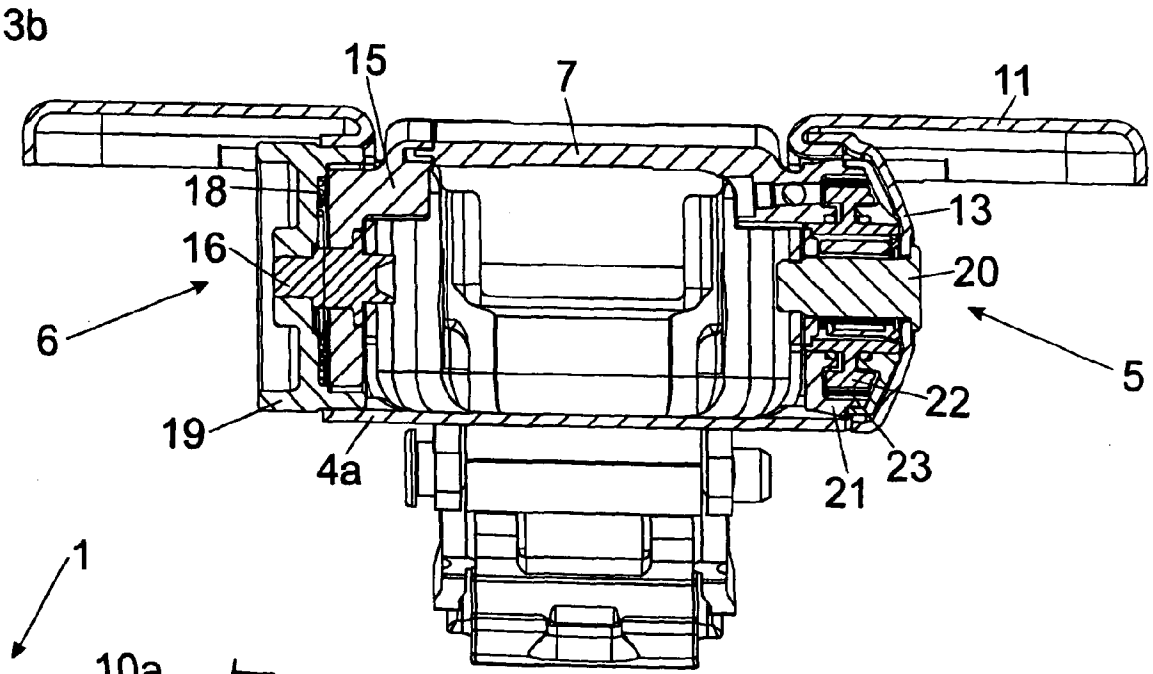
FIGS. 3*a*, 3*b* are a sectional view of the hinge and a view on an enlarged scale along section plane A-A in FIG. 3*a*.
Figure 3A:
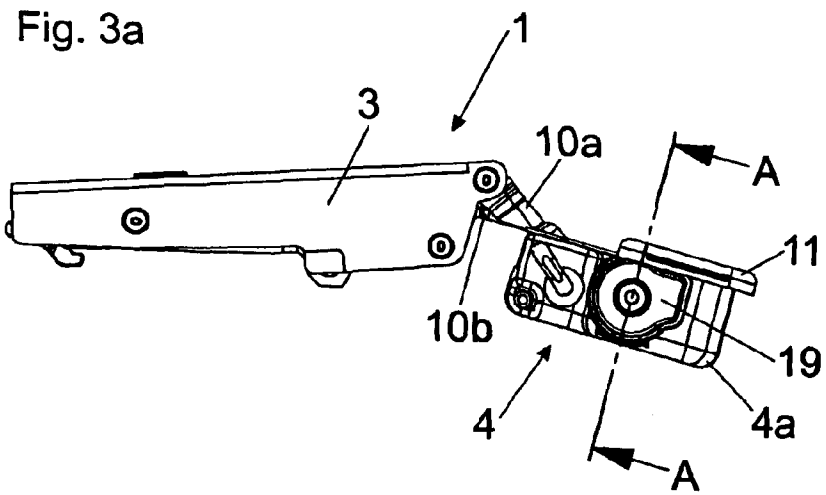

FIG. 3*a* shows a sectional view of the hinge 1 in the assembled condition. It is possible to see the first fitment portion 3 in the form of the hinge arm and the second fitment portion 4 in the form of the hinge cup 4*a* pivotally connected to the first fitment portion 3 by way of the two hinge levers 10*a*, 10*b*. The return housing 19 of the return mechanism 6 is mounted to a lateral outside wall of the hinge cup 4*a*. FIG. 3*b* shows a view on an enlarged scale along a plane in the direction of the arrows A-A in FIG. 3*a*. Upper closure is formed by the fixing flange 11 of the hinge cup 4*a*, wherein the return mechanism 6 is arranged on one side of the hinge cup 4*a* and the damping device 5 is arranged in diametrally opposite relationship thereto. The return mechanism 6 includes the stationary return housing 19 and the return element 15 which is mounted rotatably relative to the journal member 16, wherein it is possible to see the spring device 18 for the restoring movement of the return element 15. It is also possible to see the connection between the actuating element 7 and the return element 15. The damping device 5 mounted on the other side of the hinge cup 4*a* includes a central pin 20 which together with the damper housing 13 is fixed non-rotatably to the hinge cup 4*a*. The actuating element 7 is operatively connected to a rotatable damping component 21 so that, when the actuating element 7 is urged into the hinge cup 4*a*, the first damping component 21 rotates relative to the second damping component 22. Provided between the first damping component 21 and the second damping component 22 is an annular free space 23 for receiving a fluid acting as a damping medium between the damping components 21 and 22. In that way, shearing forces act on the damping medium in the free space 23, and produce the damping action. It should be noted that the illustrated damping device is only shown by way of example. Basically, the person skilled in the art can use all damping devices 5 which are suitable and known in connection with the idea of the invention.

Figure 4:
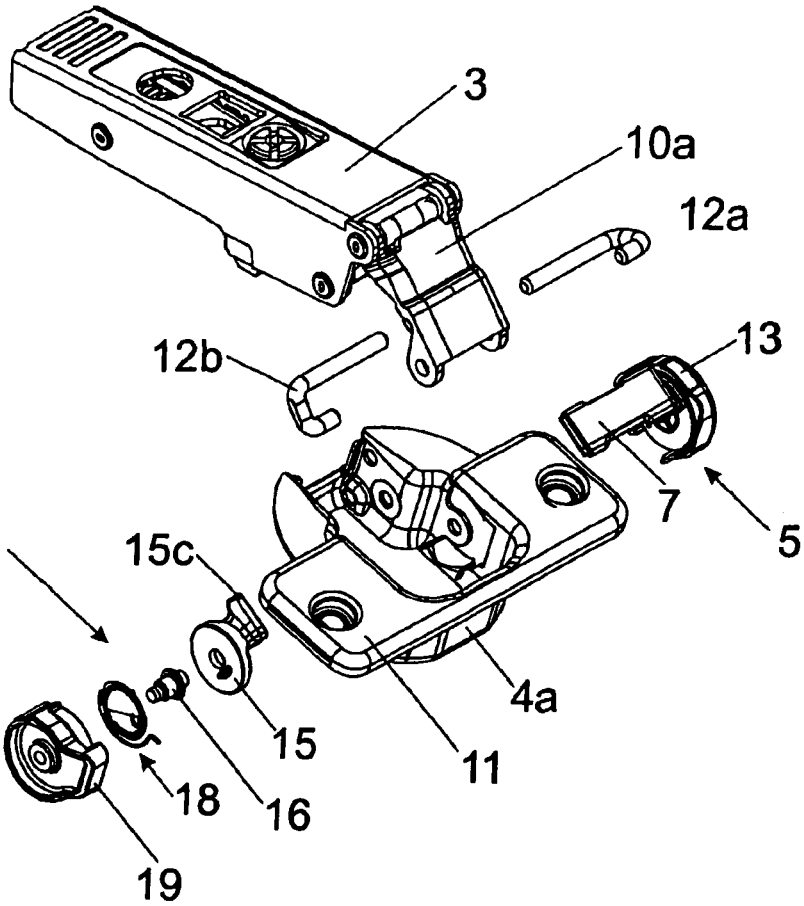
FIG. 4 is a perspective front view of the hinge in an exploded condition.

FIG. 4 shows a perspective view from above the hinge 1 in an exploded view similar to FIG. 2*b*. In this respect, the latching portion 15*c* on the return element 15 is also to be indicated as a particularity, by which it is possible to make a snap connection between the return element 15 and the actuating element 7 of the damping device 5.

Figure 5:
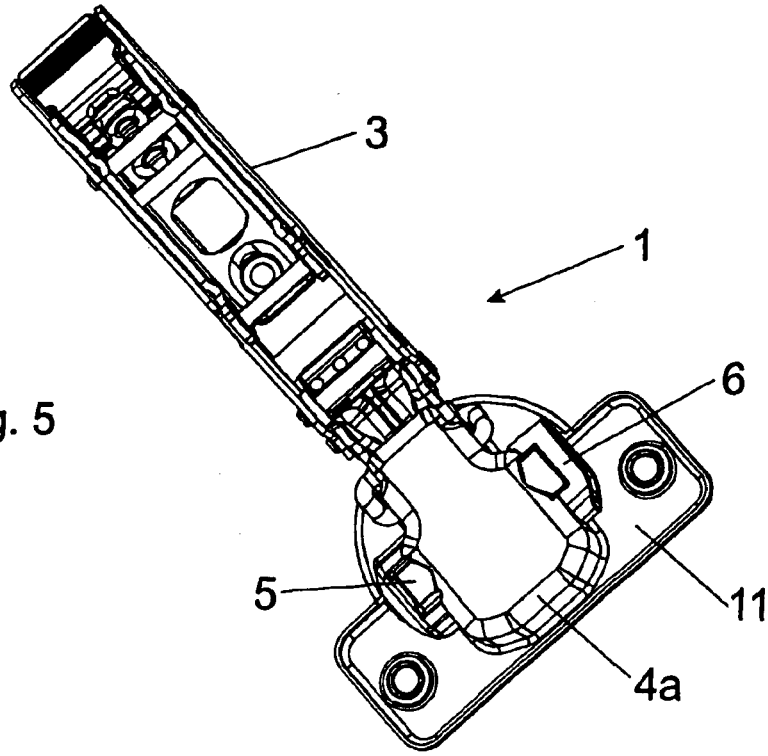
FIG. 5 is a perspective view from below of the hinge in the assembled condition.

FIG. 5 shows a perspective view from below of the hinge 1, showing the two separate structural units of the damping device 5 and the return mechanism 6. The hinge cup 4*a* can be fitted jointly with the two laterally arranged structural units in a round bore on the movable furniture portion 2. Provided for definitively fastening the hinge cup 4*a* are openings which pass through the fixing flange 11 and which are provided for screws to pass therethrough for fixing to the furniture portion.

The present invention is not limited to the illustrated embodiment, but includes or extends to all variants and technical equivalents which can fall within the scope of the claims appended hereto. The positional references adopted in the description, such as for example up, down, lateral and so forth are also related to the usual position of installation of the hinge or to the directly described and illustrated Figure and are to be appropriately transferred to the new position upon a change in position. In addition, the two structural units can be formed integrally on the hinge cup.

The invention claimed is:

1. A hinge for movable furniture portions, comprising:

at least two hingedly connected fitment portions to be fixed to furniture portions movable relative to each other, said at least two hingedly connected fitment portions including a hinge arm and a hinge cup;

a damping device for damping a hinge movement, said damping device being located on a first side wall of said hinge cup;

a return mechanism configured as a component separate from said damping device and arranged on a second side wall of said hinge cup opposite said first side wall, said damping device not having a second return mechanism incorporated therein; and an actuating mechanism including an actuating element linked to said damping device and said return mechanism and configured to move during relative movement of said at least two fitment portions so as to be moved into a ready position for a subsequent damping stroke after damping has occurred.

2. The hinge according to claim 1, wherein said damping device comprises at least two damping components mounted so as to be movable relative to each other during each damping stroke, wherein said actuating element is operatively connected to one of said at least two damping components.

3. The hinge according to claim 2, wherein said damping device further comprises a damping fluid between said damping components.

4. The hinge according to claim 1, wherein said actuating element is rotatably mounted within said hinge cup so as to be rotatable during a damping stroke and/or during a return stroke.

5. The hinge according to claim 1, wherein said actuating element is configured so that, during a closing movement of said hinge arm relative to said hinge cup, said actuating element is acted upon by one of said at least two fitment portions.

6. The hinge according to claim 1, wherein said actuating mechanism further comprises a hinge lever arranged between two of said at least two fitment portions, said actuating element being configured so that, during a closing movement of said at least two fitment portions, said actuating element is acted upon by said hinge lever.

7. The hinge according to claim 1, wherein said return mechanism includes a rotatably mounted return element, said actuating element being releasably connected to said return element to allow said return element to return said actuating element to the ready position for the subsequent damping stroke.

8. The hinge according to claim 7, wherein said return element of said return mechanism is rotatably mounted so as to rotate during each damping stroke and/or during each return stroke.

9. The hinge according to claim 7, wherein said return mechanism further includes a spring device arranged to be tensioned by said return element during a closing movement of said hinge, and arranged so that, after damping has occurred, said spring device moves said return element and said actuating element into the ready position for the subsequent damping stroke.

10. The hinge according to claim 9, wherein said spring device comprises at least one torsion spring.

11. The hinge according to claim 9, wherein said return mechanism further includes a return housing, said spring device being configured so as to operate between said return housing and said return element.

12. The hinge according to claim 11, wherein said return element is pivotally mounted with respect to said return housing.

13. The hinge according to claim 11, wherein said return housing is arranged on said hinge cup.

14. The hinge according to claim 13, wherein said return housing is arranged externally on an outside surface of said second side wall of said hinge cup so as to be located beneath a fixing flange of said hinge cup when said hinge cup is mounted within a recess of one of the furniture portions.

15. The hinge according to claim 1, wherein said damping device includes a damper housing on said hinge cup, and said return mechanism includes a return housing on said hinge cup.

16. The hinge according to claim 15, wherein said damper housing is arranged externally on an outer surface of said first side wall of said hinge cup so as to be located beneath a fixing flange of said hinge cup when said hinge cup is mounted within a recess of one of the furniture portions.

17. The hinge according to claim 16, wherein said damper housing is arranged on said first side wall of said hinge cup, and said return housing is arranged on said second side wall of said hinge cup opposite said first side wall.

* * * * *